United States Patent [19]

Ries et al.

[11] Patent Number: 4,600,518

[45] Date of Patent: Jul. 15, 1986

[54] CHOLINE FOR NEUTRALIZING NAPHTHENIC ACID IN FUEL AND LUBRICATING OILS

[75] Inventors: Donald G. Ries, Richmond; Glenn L. Roof, Sugar Land, both of Tex.

[73] Assignee: Nalco Chemical Company, Oak Brook, Ill.

[21] Appl. No.: 754,720

[22] Filed: Jul. 15, 1985

[51] Int. Cl.[4] ..... C10M 105/08; C10C 1/22

[52] U.S. Cl. ..... 252/34; 44/72; 585/4

[58] Field of Search ..... 252/34; 208/48 AA; 585/4; 44/72

[56] References Cited

U.S. PATENT DOCUMENTS

| | | | |
|---|---|---|---|
| 2,002,885 | 5/1935 | Detwiler | 252/34 |
| 2,221,162 | 11/1940 | Ashburn | 252/34 |
| 2,330,524 | 9/1943 | Shelas | 252/34 |
| 3,017,362 | 1/1962 | Cyba | 252/515 |
| 3,497,333 | 2/1970 | Thayer | 44/72 |

OTHER PUBLICATIONS

*Merck Index,* 10th Edition, Merck & Co., Inc., 1983, p. 313, J. Org. Chem., 41, 3773 (1976).

*Primary Examiner*—William R. Dixon, Jr.
*Assistant Examiner*—Cynthia A. Prezlock
*Attorney, Agent, or Firm*—John G. Premo; Donald G. Epple

[57] ABSTRACT

Choline is an effective agent for neutralizing naphthenic acids found in certain fuel and lubricating oils.

2 Claims, No Drawings

CHOLINE FOR NEUTRALIZING NAPHTHENIC ACID IN FUEL AND LUBRICATING OILS

INTRODUCTION

Most crude oils contain naphthenic acids in varying amounts. These naphthenic acids are not readily removed from the crudes and often concentrate in the distillate fractions which boil up to as high as 700° F. They are most troublesome when they occur in fuel oils and lubricating oils.

To render fuel and lubricating oils acceptable, it is necessary to remove or neutralize naphthenic acids present in these distillate fractions to an acceptable level. Excessive amounts of naphthenic acids in these fractions cause problems relating to color and corrosiveness.

The present invention relates to a method of neutralizing undesirable levels of naphthenic acids contained in fuel oils and lubricating oils to render them commercially acceptable. The invention utilizes choline which is capable of completely or partially neutralizing naphthenic acids present in these oils.

THE INVENTION

As indicated, the invention relates to a method of neutralizing at least a portion of the naphthenic acids present in fuel and lubricating oils which contain naphthenic acids which comprises treating these oils with a neutralizing amount of choline.

The amount of choline required to neutralize the naphthenic acids will vary depending upon the particular fraction to be treated, the amount of naphthenic acid present in the particular fraction, and the degree of neutralization desired. There is, therefore, no specific dosage that can be given although usually the amount of choline will be in excess of 100 ppm by weight of the distillate to be treated.

Choline

There is some confusion in the literature regarding "choline" nomenclature. *Merck Index,* 10th Edition, Merck & Co., Inc., 1983, refers to the cation, only, as choline, i.e.

$$Me_3\overset{\oplus}{N}—CH_2CH_2—OH$$

More commonly, however, the literature refers to choline as the hydroxide salt, i.e.

$$Me_3\overset{\oplus}{N}—CH_2CH_2—OH\ \overset{\ominus}{O}H$$

For example, see Journal of Organic Chemistry, Vol. 41, No. 23, 3773(1976).

Because of this confusion, we choose to define "choline" as any and all of the following species:

$$Me_3\overset{\oplus}{N}—CH_2CH_2—\overset{\ominus}{O} \qquad \text{I}$$

$$Me_3\overset{\oplus}{N}—CH_2CH_2—OH\ \overset{\ominus}{O}H \qquad \text{II}$$

$$Me_3\overset{\oplus}{N}—CH_2CH_2—OH\ \overset{\ominus}{O}R \qquad \text{III}$$

where R = alkyl ranging from $C_1$ to $C_{20+}$

All three structures (I, II, and III) are strong bases and all will neutralize naphthenic acids. Structure I is the predominant species regardless of solvent system employed. A small amount of II will coexist with I if water is the solvent or part of a cosolvent. Structure III will be present to a small extent and will be in equilibrium with structure I if an alcohol solvent such as methanol is used. For documentation of these statements, see J. Org. Chem. 41, 3773(1976).

Commercially choline is made by reacting trimethylamine with 1 mole of ethylene oxide in methanol. This reaction is usually conducted to provide a finished methanol solution of choline having a choline concentration ranging between 25–45% by weight. Contained in the reaction mixture is between 0.5–5% by weight of trimethylamine and up to about 15% by weight of various methanol ethoxylates. For purposes of the invention, this crude reaction mixture of choline, trimethylamine and methanol ethoxylates may be used.

When the methanol solution of choline produced as described above is added to the fuel oil or lubricating oils, it acts within a matter of minutes up to several hours depending upon the temperature and degree of agitation to neutralize the naphthenic acids present in these distillates. When the neutralized distillates are contacted by out of phase water, a haze forms which is comprised of water droplets containing the neutralized naphthenic acids. In time this haze will settle, but to improve processing time, it is desirable to utilize a so-called "anti-haze" additive or a water-in-oil emulsion breaker.

A preferred anti-hazing additive is afforded by reacting nonyl phenol (25.75 parts) with 4.23 parts of paraformaldehyde using an alkaliine catalyst such as potassium hydroxide to produce a low molecular weight oil-soluble phenol formaldehyde resin. This is then reacted under alkaline conditions with 44.44 parts per weight of propylene oxide. Upon completion of this reaction, the propoxylated polymer is reacted with 8.10 parts of ethylene oxide. When used in small amounts, e.g., 0.1–5% by weight, this de-hazing additive removes any haze formed when the choline neutralized fuel is contacted by out of phase water. This particular anti-haze chemical is admirably suited for use with the invention since it is soluble in methanol and may be incorporated directly into methanol solutions of choline.

Anti-haze compounds covered by the invention include cationic, anionic, and nonionic dehazing agents or emulsion breakers.

A product illustrating the best mode of the invention is set forth below as Composition 1-A.

| Ingredients | % by Weight |
|---|---|
| Composition 1 | |
| Methanol | 55% |
| Choline | 34% |
| Trimethylamine + methanol ethoxylates | Balance |
| Composition 1-A | |
| Composition 1 | 96.77% |
| Phenol formaldehyde propoxylated ethoxylate anti-haze additive | 2.657% |
| Aromatic petroleum hydrocarbon solvent and caustic | Balance |

To illustrate the advantages of the invention, Table I is presented below.

TABLE I

| Fuel | Sample | Dose of Composition 1 | Neut. No.[1] |
|---|---|---|---|
| Fuel A | Blank | — | 0.92 |
| Diesel | 1 | 3,375 ppm | 0.23 |
| | 2 | 5,000 ppm | 0.012 |
| Fuel B[2] | Blank | — | 2.09 |

TABLE I-continued

| Fuel | Sample | Dose of Composition 1 | Neut. No.[1] |
|---|---|---|---|
| Diesel | 1 | 9,580 ppm | 0.14 |
| | 2 | 11,190 ppm | 0.057 |
| Vacuum Gas | Blank | — | 2.4 |
| Oil[3] | 1 | 12,800 ppm | 0.41 |

[1]Neut. No. $\frac{\text{mg KOH}}{\text{g of sample}}$

[2]This diesel was rendered acidic by dissolving 5.4 g of commercial naphthenic acids in 500 g of the neutral diesel.

[3]This vacuum gas oil was non-neutralized. Since this fuel was so viscous, the treated fuel was mechanically stirred for 2 hours before running neut. number.

TABLE II

Table II illustrates the advantage of this invention with a lubricating oil:

| Sample | Dose of Comp. 1 | Neut. No. |
|---|---|---|
| Acidic Lube Oil Distillate | — | 5.9 |
| Treated Sample | 3.03% | 0.41 |

TABLE III

Additionally, Table III shows that once treated, the lube oil will not increase in acidity, even at 150° C.

| | Neut. No. | | |
|---|---|---|---|
| Sample | Before Heating 15½ hours at 150° C. | After Heating | Color After Heating |
| Acidic Lube Oil Distillate | 5.9 | 5.9 | Dark |
| Treated Sample | 0.43 | 0.41 | Light |

Not only does the treated sample hold its Neut. No., but it is more color stable than untreated fuel at this elevated temperature.

An acidic fuel or lubricating oil which has had its acidity reduced by the application of choline is less corrosive toward metals and metal alloys. This attendant benefit is exemplified in Table IV.

Fuel corrosivity tests were carried out by adding 50 ml of test fuel and 5 ml of tap water to a 2 oz. bottle. After shaking for 10 seconds, a preweighed metal coupon was added to each bottle. The bottles were capped and allowed to stand for 7 days at 110° F. After 7 days, the coupons were withdrawn, rinsed with isopropanol, wiped dry and weighed. The amount of weight loss is proportional to the corrosivity of the fuel. The fuel used in this study was acidic straight run diesel.

TABLE IV

| METAL | SAMPLE | I.D. | NEUT. NO. | WEIGHT LOSS (mg) |
|---|---|---|---|---|
| Zinc | 1 | Blank | 0.92 | 20.3 |
| | 2 | Blank | 0.92 | 17.4 |
| | 3 | Treated[1] | 0.28 | 2.0 |
| | 4 | Treated | 0.28 | 2.3 |
| | 5 | Control[2] | 0.30 | 5.6 |
| | 6 | Control | 0.30 | 5.1 |
| Solder[3] | 1 | | | 72.7 |
| | 2 | | | 70.4 |
| | 3 | | | 23.9 |
| | 4 | | | 30.5 |
| | 5 | | | 35.0 |
| | 6 | | | 31.1 |
| Tern Metal[3,4] | 1 | | | 74.1 |
| | 2 | | | 48.4 |
| | 3 | | | 15.2 |
| | 4 | | | 6.4 |
| | 5 | | | 33.7 |
| | 6 | | | 20.2 |
| Lead | 1 | | | 99.4 |
| | 2 | | | 113.0 |
| | 3 | | | 49.4 |
| | 4 | | | 60.0 |
| | 5 | | | 56.2 |
| | 6 | | | 57.9 |

[1]Treated fuel was prepared by dosing the acidic diesel with 3,375 ppm of a 33.8% solution of choline in methanol which lowered the neut. no. from 0.92 to 0.28.

[2]A control fuel was prepared by diluting blank fuel with sufficient heptane to reduce the neut. no. to 0.30. This control was used because of proposed customer specifications.

[3]Both solder and tern metal are lead/tin alloys:
Solder - 70% lead/30% tin
Tern Metal - 85% lead/15% tin

[4]Tern metal is the alloy used to coat the inside of automobile diesel tanks.

This data clearly illustrates the reduced corrosivity of acidic diesel treated with choline.

We claim:

1. A method of neutralizing at least a portion of the naphthenic acids present in fuel and lubricating oils which contain naphthenic acids which comprises treating these oils with a neutralizing amount of choline.

2. The method of claim 1 where the choline is used with an anti-haze additive or water-in-oil demulsifier.

* * * * *